United States Patent [19]

Swank

[11] Patent Number: 4,615,571

[45] Date of Patent: Oct. 7, 1986

[54] STORAGE APPARATUS AND SORTING TRAY

[75] Inventor: Robert P. Swank, Mansfield, Ohio

[73] Assignee: Leiter Industries, Inc., Lexington, Ohio

[21] Appl. No.: 740,874

[22] Filed: Jun. 3, 1985

Related U.S. Application Data

[63] Continuation-in-part of Ser. No. 607,507, May 7, 1984.

[51] Int. Cl.[4] ..... B65B 67/02; B65D 91/00

[52] U.S. Cl. ..... 312/211; 312/117; 312/120; 312/123; 312/326

[58] Field of Search ..... 312/117, 211, 212, 120, 312/123, 322, 325, 326, 327, 328, 136

[56] References Cited

U.S. PATENT DOCUMENTS

| | | | |
|---|---|---|---|
| 207,967 | 9/1878 | Hudson . | |
| 222,816 | 12/1879 | Daniel | 312/327 |
| 246,873 | 9/1881 | Ducker . | |
| 354,421 | 12/1886 | Houser . | |
| 399,509 | 3/1889 | Ellithorpe . | |
| 435,282 | 8/1890 | Cladek | 312/325 |
| 614,827 | 11/1898 | Bonham . | |
| 645,504 | 3/1900 | Daggett . | |
| 658,983 | 10/1900 | Francis . | |
| 883,906 | 4/1908 | Swan | 312/123 |
| 899,399 | 9/1908 | Hornig . | |
| 1,041,892 | 10/1912 | Sieling . | |
| 1,219,657 | 3/1917 | Melchert . | |
| 1,333,233 | 3/1920 | Ward . | |
| 1,919,082 | 7/1933 | Wheary | 312/327 |
| 1,937,337 | 11/1933 | Gaa . | |
| 1,954,085 | 4/1934 | McMillan | 312/328 |
| 2,205,572 | 6/1940 | McCann et al. . | |
| 2,343,042 | 2/1944 | Barry . | |
| 2,542,162 | 2/1951 | Sutton | 312/328 |
| 2,615,567 | 10/1952 | Campbell . | |
| 2,710,712 | 6/1955 | Friedman . | |
| 3,044,621 | 7/1962 | Pearlman et al. . | |
| 3,193,339 | 7/1965 | Cooper | 312/123 |
| 3,198,143 | 8/1965 | Biglieri | 312/117 |
| 3,238,953 | 3/1966 | Barbie . | |
| 3,243,040 | 3/1966 | Cutter . | |
| 3,297,375 | 1/1967 | Reeves . | |
| 3,613,566 | 10/1971 | Shapleigh, Jr. | 312/322 |
| 3,747,756 | 7/1973 | Wheeler . | |
| 4,062,604 | 12/1977 | Popper | 312/328 |
| 4,162,112 | 7/1979 | Konkler . | |
| 4,217,013 | 8/1980 | Herrington et al. | 312/322 |
| 4,298,157 | 11/1981 | DeVierno . | |
| 4,494,804 | 1/1985 | O'Keeffe . | |

FOREIGN PATENT DOCUMENTS

| | | |
|---|---|---|
| 198655 | 5/1907 | Fed. Rep. of Germany . |

*Primary Examiner*—Victor N. Sakran

*Attorney, Agent, or Firm*—Wood, Herron & Evans

[57] ABSTRACT

A combined storage apparatus and sorting tray includes a frame formed with a storage bin for storing containers and a tray pivotally mounted to the frame. The tray has an end panel formed with a slot adapted to receive a lip formed at the rim of a container for mounting the container to the end panel so that its interior faces the interior of the tray. The tray is pivotal with respect to the frame between a horizontal, sorting position in which articles from the container are poured into the tray for sorting, and an angled, discharge position in which the tray is elevated at one end so that the articles slide directly into the container mounted at the opposite end.

7 Claims, 3 Drawing Figures

STORAGE APPARATUS AND SORTING TRAY

RELATED CASES

This application is a continuation-in-part of application Ser. No. 607,507, filed May 7, 1984 and entitled "Combination Multiple Compartment Storage Bin and Sorting Tray".

BACKGROUND OF THE INVENTION

This invention relates to a storage apparatus for a plurality of containers, and, more particularly, to a storage apparatus incorporating a sorting tray adapted to permit sorting of the contents of a container and then to return such contents directly into the container for storage.

It is commonplace to store large numbers of articles such as bolts, nuts, screws, washers and the like in a number of separate bins or containers. Often, articles of different sizes and/or types are mixed together in a single container which requires sorting to obtain the particular article desired. Sorting is usually done by either rooting through the articles within the container or spilling the contents of the container out onto a surface.

Unless the container has a wide mouth and is relatively shallow, it is difficult to reach into a container and sort through its contents. In most cases, the articles in the container are simply spilled out over a surface for easier access. The problem then becomes one of easily returning the unused articles back into the container without dropping or losing them.

One solution to this problem proposed in the prior art is a tray adapted to receive articles from a container which includes a funnel or shoe at one end through which the articles are poured to return them to the container. Usually, these trays are stored apart from the containers and may become lost or misplaced. In addition, such trays are free-standing and relatively easy to upset while sorting through articles placed in the trays and upon pouring the articles back into a container after sorting.

SUMMARY OF THE INVENTION

It is therefore among the objects of this invention to provide, in combination, a storage apparatus and sorting tray which are interconnected so that the sorting tray will always be readily available.

It is another object herein to provide a stable sorting tray which will not tip over during sorting of articles or upon returning them to the containers.

It is a further object of this invention to provide a storage apparatus and sorting tray for the storage of a plurality of individual containers.

These objectives are accomplished in a combination of a storage apparatus and sorting tray according to this invention which comprises a frame formed with a storage bin adapted to support a plurality of containers, and a sorting tray pivotally mounted to the frame. One end of the tray is formed with means for releasably mounting a container so that its interior faces the interior of the tray. The tray is pivotal between a generally horizontal, sorting position and an angled discharge position. Articles from a container are placed into the tray for sorting with the tray in a horizontal position, and the container is mounted to the tray. The end of the tray opposite the mounting means is then elevated to move the tray to the angled position so that the articles can slide downwardly along the tray and directly into the container.

More specifically, in one presently preferred embodiment of this invention, the sorting apparatus and tray include a frame having interconnected top, bottom, front, back and opposed side panels forming a storage bin for receiving a plurality of individual containers. The storage bin is divided into a number of compartments by spaced shelves which support the containers. The front panel is pivotally mounted to the bottom panel for movement between an open, horizontal position and a closed vertical position, and is adapted to pivotally mount the tray. The tray is preferably a rectangular-shaped box with an open top, having one end formed with an inner wall spaced from an outer wall. The space or slot formed between the inner and outer walls is adapted to slidably receive a lip formed at the rim of a container for mounting the container to the tray. The tray is pivotal between a generally horizontal position to permit sorting of the contents of a container and an angled discharge position wherein the end of the tray opposite the slot is lifted vertically so that the articles slide along the tray and directly into the container mounted to the slot.

In an alternative embodiment, the storage apparatus and tray of this invention include a frame having upright end panels connected to a base panel. A generally rectangular-shaped tray having an open top is disposed atop the upright end panels and one end of the tray is pivotally mounted to one of the end panels. A plurality of containers are adapted to be supported by the bottom panel of the frame beneath the tray. One end of the tray is essentially identical to that of the tray of the embodiment described above, including an inner and outer wall which are spaced from one another forming a slot adapted to receive a lip formed at the rim of a container. The tray is pivotal with respect to the frame between a horizontal sorting position and an angled discharge position wherein the end of the tray opposite the slot is elevated so that the articles in the tray slide toward the slot and directly into the container mounted thereat.

The storage apparatus and sorting tray of this invention are connected in a single unit so that the tray is always readily available for sorting of articles from the containers. In addition, the tray is securely mounted to the frame so that it will not tip over when the articles are being sorted or returned to the container. Articles can be easily and neatly sorted with the combined storage apparatus and sorting tray herein, and then quickly returned to the appropriate container.

DESCRIPTION OF THE DRAWINGS

The structure, operation and advantages of a presently preferred embodiment of this invention will become further apparent upon consideration of the following description taken in conjunction with the accompanying drawings wherein.

DETAILED DESCRIPTION OF THE INVENTION

Figure 1:
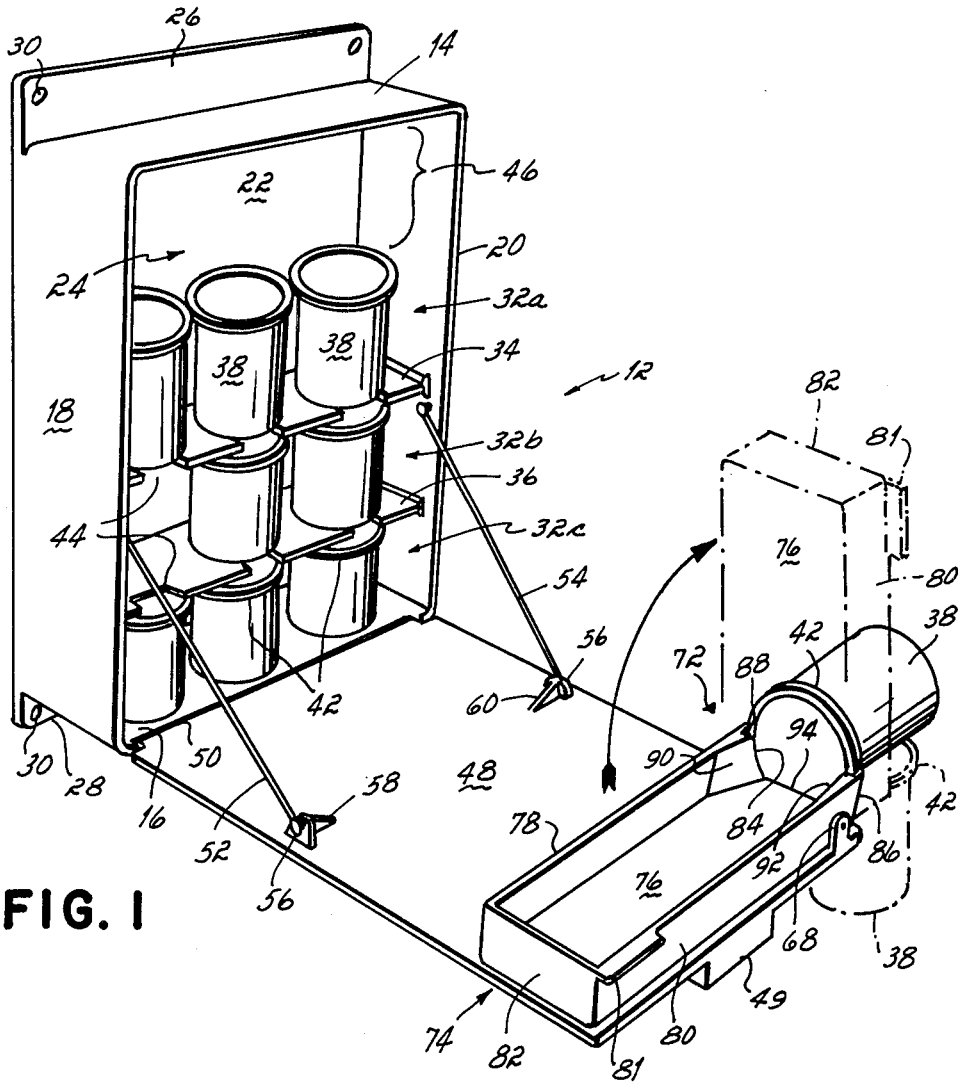
FIG. 1 is a perspective view of one embodiment of a combined storage apparatus and sorting tray according to this invention wherein the sorting position of the tray is illustrated in solid lines and the discharge position thereof is illustrated in phantom.

Referring now to FIG. 1, one embodiment of the combined storage apparatus and sorting tray according to this invention is illustrated. The combination includes a generally rectangular, upright frame 12 including a top panel 14, bottom panel 16, opposed side panels 18, 20 and a back panel 22 which are interconnected to form a storage bin 24. The back panel 22 is formed with upper and lower flanges 26, 28 having mounting bores 30 for mounting the frame 12 to a support (not shown).

The storage bin 24 formed by frame 12 is divided into three separate compartments 32*a–c* by a pair of spaced shelves 34, 36 which are mounted at opposite ends to side panels 18, 20. Each shelf 34, 36 is adapted to support a plurality of containers 38 which are formed with a top rim having a radially outwardly extending lip 42. Preferably, the shelves 34, 36 are formed with spaced notches 44 which align with the containers 38 supported thereon so that one may reach directly into the container 38 through the notch 44 to facilitate removal from the shelves 34, 36. The shelves 34, 36 are positioned within storage bin 24 to provide a space 46 between top panel 14 and the containers 38 supported atop shelf 34, for purposes to become apparent below.

The frame 12 also includes a front panel 48 having a handle 49, which is pivotally mounted at its lower end 50 to the bottom panel 16 by a hinge, pins or other suitable means (not shown). The front panel 48 is supported in an open, generally horizontal position, as shown in FIG. 1, by a pair of rods 52, 54 which extend between the side panels 18, 20, respectively, and the front panel 48. The rods 52, 54 are mounted to the front panel 48 by pins 56 connected to mounting tabs 58, 60, and the opposite end of rods 52, 54 are pinned to the side panels 18, 20.

The upper end 66 of front panel 48 is formed with a pair of spaced ears 68 which pivotally mount one end panel 72 of a sorting tray 74 to the front panel 48. The sorting tray 74 is generally rectangular having a bottom panel 76, opposed side panels 78, 80 and a second end panel 82. As shown in FIG. 1, the ears 68 are pinned to the side panels 78, 80, respectively, of tray 74 near the end panel 72.

Figure 2:
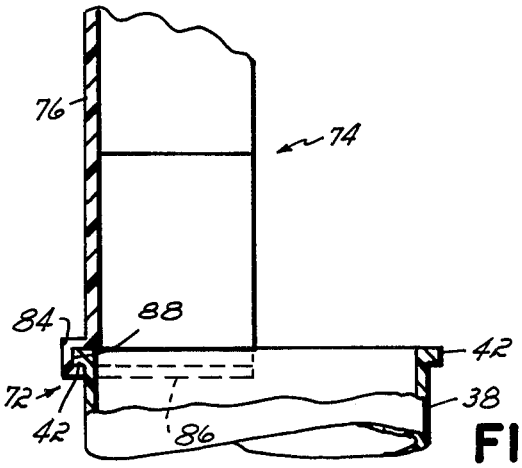
FIG. 2 is an end view of the mounting slot of the tray in FIG. 1 shown in the discharge position.

Referring now to FIGS. 1 and 2, the end panel 72 includes an inner wall 84 and an outer wall 86 which are spaced apart forming a slot 88 therebetween. The inner wall 84 is connected to each side panel 78, 80 of the tray 74 and is further supported by braces 90, 92. The inner wall 84 is formed with a generally rectangular-shape cut-out 94 having an open top and a bottom surface coincident with the plane of bottom panel 76. The outer wall 86 is connected to each side panel 78, 80 and includes a semicircular-shaped cut-out 96 having an open top and a bottom surface which extends beneath the plane of the bottom panel 76.

The apparatus 10 is used as follows. The front panel 48 is first placed in the open, horizontal position as shown in FIG. 1. One of the containers 38 is removed and its contents dumped into the tray 74 for sorting. The container 38 is then mounted to the tray 74 by sliding its outwardly extending lip 42 within the slot 88 formed between the inner and outer walls 84, 86 of end panel 72 so that the interior of the container 38 is open to the interior of tray 74. As shown in solid lines in FIG. 1, the tray 74 is positioned generally horizontally atop the front panel 48 while the contents of container 38 are sorted. Once the appropriate article has been found, the remaining articles are returned to the container 38 by pivoting the tray 74 to an upright, discharge position shown in phantom in FIG. 1. The end of the tray 74 opposite the container 38 is lifted vertically upwardly by the handle 81 on side panel 80, allowing the articles to slide downwardly along tray 74 and directly into the interior of container 38. The container 38 is then removed from the slot 88 and returned to its place on shelf 36.

When not in use, the front panel 48 is pivoted upwardly to close the storage bin 24 of frame 12. The space 46 between the containers 38 on shelf 34 and the top panel 14 is greater than the width of tray 74 so that the tray can be received within the storage bin 24 without interfering with the containers 38.

Figure 3:
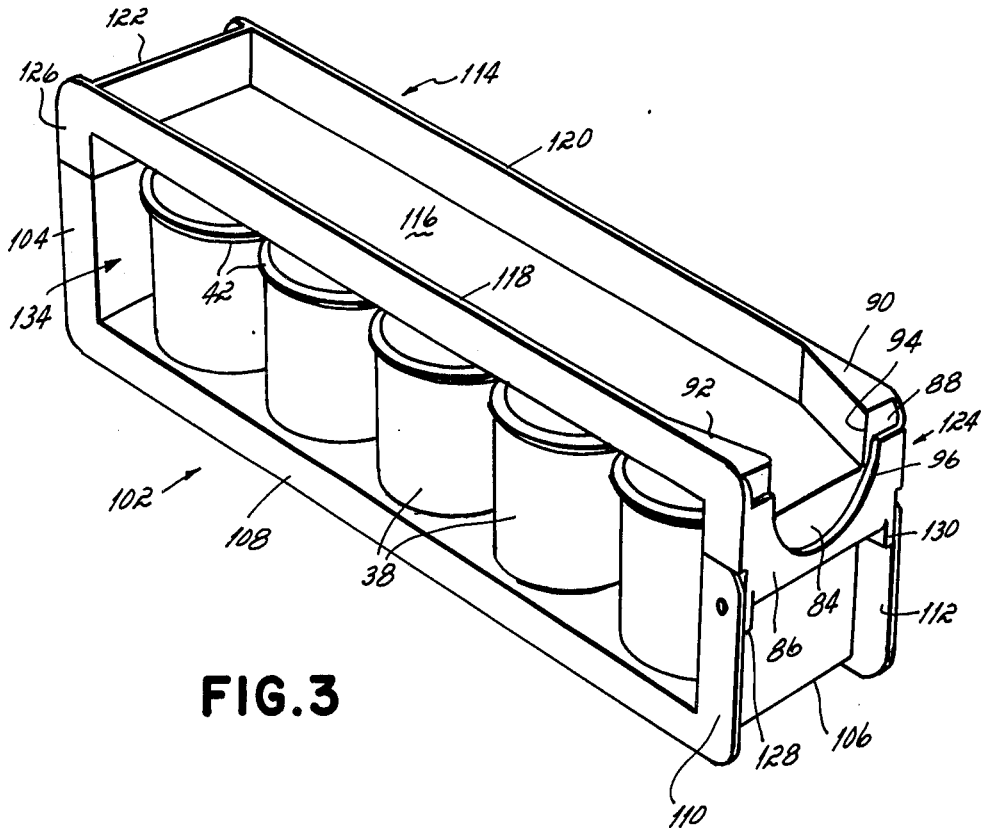
FIG. 3 is a perspective view of an alternative embodiment of the storage apparatus and mounting tray combination of this invention.

Referring now to FIG. 3, an alternative embodiment of a combination storage apparatus and sorting tray according to this invention is illustrated. The combination includes a frame 102 having opposed upright end panels 104, 106 connected to opposite ends of a bottom panel 108. The end panel 106 includes a pair of outwardly extending flanges 110, 112 at each side edge.

A sorting tray 114 extends above the bottom panel 108 between the end panels 104, 106. The tray 114 is generally rectangular in shape having a bottom panel 116, opposed side panels 118, 120, and opposed end panels 122, 124 all of which are interconnected to form the tray 114. The end panel 122 includes a leg 126, disposed perpendicularly relative to the bottom panel 116, which is adapted to engage the upper surface of the frame end panel 104. The other end panel 124 of tray 114 is identical to the end panel 82 of the apparatus 10 shown in FIGS. 1 and 2, except for the addition in this embodiment of downwardly extending ears 128, 130 which are pinned to the flanges 110, 112, respectively, of end panel 106 for pivotally mounting the tray 114 upon the frame 102. Since the end panel 124 is identical to end panel 82, the same reference numerals appearing in FIGS. 1 and 2 are shown in FIG. 3 for the same structural elements.

A plurality of containers 38 are adapted to be stored in a storage bin 134 formed between the bottom panel 108 of the frame 102 and the tray 114. As shown in FIG. 3, the containers 132 are supported atop the bottom panel 108 and beneath the tray 114. The containers 38 are identical to containers 38 described above, and the same reference numerals used in FIGS. 1 and 2 are applied in this embodiment for the same structural features.

The combination of FIG. 3 is used in essentially the identical manner as the combination of FIGS. 1 and 2. One of the containers 38 is removed from storage bin 134 and its contents are poured into the tray 114. The container 38 is then mounted to the end panel 124 of tray 114 by inserting its lip 42 within the slot 88 formed in the end panel 124. The tray 114 is pivotal between a generally horizontal, sorting position shown in FIG. 3, and an upright, discharge position (not shown). Once the articles in tray 114 have been sorted, they are returned directly into the container 38 by elevating the end panel 122 so that the tray 114 pivots with respect to the frame 102. The articles in tray 114 slide directly into the container 38 mounted at end panel 124, and the container 38 is thereafter removed from end panel 124 and replaced into the storage bin 134.

While the invention has been described with reference to a preferred embodiment, it should be understood by those skilled in the art that various changes may be made and equivalents may be substituted for elements thereof without departing from the scope of this invention. For example, the cut-out 94 in outer wall 86 is generally semicircular in shape to mount the lip of a cylindrical container between the inner and outer walls 84, 86 of the end panels 82, 124. It is contemplated that the outer wall 86 could be formed with cut-outs of other cross section, such as square or rectangular, to receive lips from containers having shapes other than cylindrical.

In addition, many modifications may be made to adapt a particular situation on a material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. In combination, a storage apparatus and sorting tray comprising:

a frame having a bin for storing containers;

a tray having first and second ends, said first end being pivotally mounted to said frame, said tray being adapted to receive articles for sorting;

mounting means for mounting a container to said first end of said tray;

said tray and the container mounted thereto being movable with respect to said frame between a generally horizontal, sorting position and an angled discharge position, said second end of said tray being disposed vertically above said first end of said tray and the container in said angled, discharge position, the articles within said tray being discharged into the container mounted to said tray upon pivoting said tray and the container to said angled position, the container thereafter being removed from said tray and returned to said bin for storage.

2. The combination of claim 1 in which said frame includes interconnected top, bottom, front, back and opposed side panels forming said bin, said front panel being pivotally connected to said bottom panel, said tray being pivotally mounted to said front panel.

3. The combination of claim 2 in which said bin includes spaced shelves connected between said opposed side panels for dividing said bin into compartments, each of said shelves being adapted to support containers within a compartment.

4. The combination of claim 1 in which said frame includes opposed, upright end panels connected to a bottom panel, said bottom panel being adapted to support containers.

5. The combination of claim 4 in which said tray is supported atop said opposed, upright end panels and is pivotally mounted to one of said upright, end panels, said tray and said bottom panel forming a storage bin therebetween for storing containers.

6. The combination of claim 1 in which said first end of said tray is formed with a slot, said combination further including a container having a rim formed with a lip, said lip being insertable within said slot for mounting said container to said tray.

7. The combination of claim 6 in which said slot comprises spaced inner and outer walls, said space being greater than the width of said lip, said inner and outer walls each being formed with a cut-out portion having an open top, said containers being mounted to said tray by sliding said lip into said space between said inner and outer walls from said open top thereof so that the interior of said container substantially aligns with said cut-out portions in said inner and outer walls.

* * * * *